US011813627B2

(12) United States Patent
Perignon

(10) Patent No.: US 11,813,627 B2
(45) Date of Patent: Nov. 14, 2023

(54) FLUID PRODUCT DISPENSER

(71) Applicant: APTAR FRANCE SAS, Le Neubourg (FR)

(72) Inventor: Fabrice Perignon, La Chapelle Fortin (FR)

(73) Assignee: APTAR FRANCE SAS, Le Neubourg (FR)

( * ) Notice: Subject to any disclaimer, the term of this patent is extended or adjusted under 35 U.S.C. 154(b) by 3 days.

(21) Appl. No.: 17/623,088

(22) PCT Filed: Jul. 1, 2020

(86) PCT No.: PCT/FR2020/051145
§ 371 (c)(1),
(2) Date: Dec. 27, 2021

(87) PCT Pub. No.: WO2021/001626
PCT Pub. Date: Jan. 7, 2021

(65) Prior Publication Data
US 2022/0258193 A1 Aug. 18, 2022

(30) Foreign Application Priority Data
Jul. 1, 2019 (FR) ..... 1907285

(51) Int. Cl.
*B05B 11/00* (2023.01)
*B05B 11/10* (2023.01)
*A45D 34/04* (2006.01)

(52) U.S. Cl.
CPC ..... *B05B 11/1052* (2023.01); *A45D 34/045* (2013.01); *B05B 11/1047* (2023.01); *A45D 2200/056* (2013.01)

(58) Field of Classification Search
CPC ..... B05B 11/1052; B05B 11/1047; A45D 34/045; A45D 2200/056; A45D 34/04;
(Continued)

(56) References Cited

U.S. PATENT DOCUMENTS 3,341,884 A * 9/1967 Pryor ..... A45D 34/042 401/160
5,865,194 A * 2/1999 Gueret ..... A45D 33/02 132/307

(Continued)

FOREIGN PATENT DOCUMENTS

FR 2 981 553 A1 4/2013
FR 3 070 121 A1 2/2019
JP 2015-105106 A 6/2015

OTHER PUBLICATIONS

International Search Report for PCT/FR2020/051145 dated Sep. 30, 2020.

(Continued)

*Primary Examiner* — Vishal Pancholi
(74) *Attorney, Agent, or Firm* — Sughrue Mion, PLLC

(57) ABSTRACT

Fluid product dispenser having a reservoir, a pump having an actuating stem, a cup mounted on the actuating stem for accommodating the product output by the pump, and a removable member engaged with the cup and having an applicator held in the cup to take up the product, the applicator being deformable and constrained in the cup by a rotational locking mechanism having a plurality of fixed flanges solidly attached to the reservoir and a plurality of fins integral with the removable member. The cup and the removable member are provided with a rotational connection mechanism, such that the removable member drives the cup in rotation on the actuating stem, as soon as the removable member is engaged with the cup.

11 Claims, 4 Drawing Sheets

(58) Field of Classification Search
CPC ..... A45D 34/00; A45D 44/00; B65D 47/20; B65D 41/62; B65D 51/18; B65D 2251/0015; B65D 2251/0087; A61J 1/05; A61J 1/14
See application file for complete search history.

(56) References Cited

U.S. PATENT DOCUMENTS

| | | | | |
|---|---|---|---|---|
| 5,945,076 | A * | 8/1999 | Leonard | A46B 11/0006 222/93 |
| 6,309,124 | B1 * | 10/2001 | Gueret | B65D 51/24 401/125 |
| 6,945,723 | B1 * | 9/2005 | Gueret | A45D 33/02 401/125 |
| 7,377,296 | B2 * | 5/2008 | Gueret | A45D 34/042 401/125 |
| 2002/0048481 | A1 * | 4/2002 | Gueret | A45D 34/045 401/126 |
| 2016/0022005 | A1 * | 1/2016 | Suzuki | A45D 40/10 401/126 |

OTHER PUBLICATIONS

Written Opinion for PCT/FR2020/051145 dated Sep. 30, 2020.
International Preliminary Report on Patentability (with translation of the Written Opinion) dated Dec. 28, 2021, issued by the International Bureau in application No. PCT/FR2020/051145.

* cited by examiner

FLUID PRODUCT DISPENSER

CROSS REFERENCE TO RELATED APPLICATIONS

This application is a National Stage of International Application No. PCT/FR2020/051145 filed Jul. 1, 2020, claiming priority based on French Patent Application No. 1907285 filed Jul. 1, 2019.

The present invention relates to a fluid product dispenser comprising a reservoir and a pump having a pump body, a return spring, and an actuating stem that is axially movable down and up between an extended rest position and a depressed actuated position. The dispenser also comprises a cup for collecting the fluid product output by the pump, the cup being mounted on the actuating stem of the pump. The dispenser also comprises a removable member including an applicator that is held in the cup so as to take up fluid product.

Thus, the user can grasp the reservoir with one hand and remove the gripping member with the other hand in order to be able to apply the fluid product taken up by the applicator on a desired application surface, such as for example the skin, hair, nails, etc. The preferred field of application of the present invention is that of cosmetics, without however excluding perfumery, pharmaceuticals and hair care.

In the prior art, document EP 1 020 135 A1 is known, which describes a fluid product dispenser of that type, comprising a reservoir, a pump that is mounted on the reservoir, and a member that is mounted on the pump so as to actuate it. The member comprises a cup mounted on the actuating stem of the pump and an applicator removably mounted on the cup. The applicator is porous and held in the cup with some deformation. It defines a bearing surface on which it is possible to press axially so as to move the member and thus actuate the pump so as to load the applicator with fluid product.

The applicator is screwed onto the member, at the outer wall of the top edge of the cup. Consequently, the applicator rubs in the cup during screwing and unscrewing operations. This results in twisting of the applicator which can deform it or damage it. Thus, to dispense a dose, it is necessary to lock the applicator by screwing.

Furthermore, the entire weight of the member and of the applicator rests entirely on the actuating stem of the pump in the dispenser of document EP 1 020 135 A1. There may also be friction between the member and the reservoir, given that the member is engaged tightly around the reservoir. This weight and friction may prevent the pump from returning to its closed and sealed rest state. It is therefore possible, or even probable, that the pump remains open between two uses, such that its content, as well as that of the reservoir, remains in communication with the external environment, which may be detrimental in terms of preservation and integrity of the fluid product, in particular in the case of cosmetic products.

In addition, the dispenser may be actuated unintentionally, in particular while it is being transported/stored. The applicator can thus be overloaded with product.

The present invention aims to improve that type of dispenser by protecting the applicator in its cup and the fluid product in the pump and the reservoir.

To do this, the present invention proposes a fluid product dispenser comprising:

a fluid product reservoir, a pump having a pump body, and an actuating stem that is axially movable back and forth between an extended rest position and a depressed actuated position;

a cup for collecting the fluid product output by the pump, the cup being mounted on the actuating stem, a removable member suitable for engaging with the cup and comprising an applicator held in the cup so as to take up fluid product, the applicator being elastically deformable and constrained in the cup by rotational locking means comprising a plurality of fixed flanges solidly attached to the reservoir and a plurality of fins integral with the removable member, the fins being suitable for engaging beneath the fixed flanges by rotation of the removable member, characterized in that the cup and the removable member are provided with rotational connection means, so that the removable member drives the cup in rotation on the actuating stem, as soon as the removable member is engaged with the cup.

Thus, it is guaranteed that the applicator does not rub against the inner wall of the cup during locking and unlocking operations. The applicator is of course constrained in the cup, but does not undergo any torsion, only axial and/or radial compression. Of course, the cup must be mounted rotatably on the actuating stem or, as a variant, the actuating stem must be able to rotate in the pump body with the cup.

Advantageously, the rotary connection means comprise a plurality of receiving housings formed by the cup and a plurality of connection profiles formed by the removable member, the connection profiles being housed in the receiving housings as soon as the removable member is engaged with the cup. Preferably, the connection profiles are formed or constituted by the fins. In practice, the angular orientation of the removable member relative to the reservoir is imposed by the fixed flanges. Consequently, the user must rotate the removable member until the fins engages between the fixed flanges. This engagement orientation may be limited to a few degrees, e.g. 1° to 10°. The fins therefore engage between the fixed flanges and immediately come to be housed in the receiving housings of the cup, which is correctly oriented with respect to the fixed flanges. After that, the removable member and the bucket are integral in rotation. The user can rotate the removable member (with the bucket) to bring its fins beneath the fixed flanges. The dispenser is thus in its rest position. Later, when the user wishes to use the dispenser, he starts by rotating the removable member (with the cup) to disengage its fins from beneath the fixed flanges. As soon as the fins have been released from the fixed flanges, the user can either press on the removable member so as to actuate the pump and load the applicator with fluid product, then separate the removable member from the bucket, or directly separate the removable member from the bucket. In both cases, the cup remains in place relative to the reservoir, so that when the removable member is put back into place on the cup, the receiving housings are correctly positioned relative to the fixed flanges so as to be able to receive the fins of the removable member. As a result, the receiving housings are always correctly positioned, since they retain their position when the fins leave them.

In another advantageous aspect of the invention, the locking means may further comprise at least one locking ramp defining a low ramp section and a high ramp section connected together by an inclined ramp section, the low ramp section being positioned between two fixed flanges and the high ramp section being positioned axially beneath a fixed flange, such that the bucket and the removable member are locked axially with a fin and a receiving housing disposed between the high ramp section and the fixed flange, with the actuating stem in the extended rest position.

While the fixed flanges ensure axial locking upwards, the ramps ensure axial locking downwards, such that the removable member and the cup are axially locked in a locked position, which corresponds precisely to the extended rest position of the pump, in which it is known that it is certainly closed and sealed. Even if the actuating stem has not returned to its extended rest position after an actuation, the ramp, by virtue of its inclined ramp section, will pull the actuating stem upwards so as to return it to its extended rest position. This can occur, in particular because of the friction that can occur between the various moving parts.

According to another advantageous characteristic, the removable member may comprise an abutment collar that comes into axial abutment on the fixed flanges in the depressed actuating position of the actuating stem. Thus, the removable member is perfectly stable in the depressed position. In addition, the dose of fluid product to be dispensed can be set in this way.

In a practical embodiment, the dispenser comprises three fixed flanges, three fins, three receiving housings and three locking ramps, so that the rotation of the removable member is limited to 60°.

According to another characteristic, the applicator may presents a rest axial height when it is not constrained in the cup, and a reduced axial height when it is constrained in the cup by the locking means, the axial height representing between 75% to 95% of the axial rest height. Advantageously, the applicator present a compression ratio, both axially and radially, of at least 15%. Preferable, the applicator completely fills the cup completely, when it is constrained therein by the locking means.

It can be noted that the applicator is elastically deformable and that it is constrained in the cup by locking means. Thus, when the removable member is in place on the cup, the applicator presents a volume, and as a result a surface area, that are small compared to the volume and surface area when the applicator is not constrained in any way. The applicator relaxes towards its rest configuration when it is removed from the cup, which performs the function of a confinement enclosure confining the applicator by deforming it elastically in reversible manner.

In another advantageous aspect, the dispenser includes a fastening ring that supports the pump and that is mounted on the reservoir, the fastening ring forming the at least one locking ramp. Advantageously, a locking crown is mounted on the fastening ring, this locking ring forming the fixed flanges.

Advantageously, the cup has a substantially rounded shape, and the applicator is substantially conical or bullet-shaped at rest, the applicator deforming in the cup until it takes on the rounded shape of the cup, the applicator advantageously forming a end tip that alone is likely to come into contact with the cup, when said applicator is not constrained in the cup. The applicator may also form one or more plane faces. The shape of the applicator should be adapted as a function of the fluid product that is to be dispensed and of the nature of the target.

In a practical aspect, the removable member may comprise a gripping element and an applicator support in which the applicator is mounted, the gripping element being mounted in removable manner on the applicator support. It is thus possible to remove the applicator support (with its applicator) from the gripping element so as to clean it or replace it. By way of example, it is possible to provide a plurality of identical or different applicators in a kit.

The spirit of the invention resides in making the removable member integral with the bucket in rotation so as to avoid any damage by twisting. The locking ramp ensures that the pump is closed and sealed when the dispenser is not used.

The invention is described more fully below with reference to the accompanying drawings, which show an embodiment of the invention by way of non-limiting example.

Figure 1:
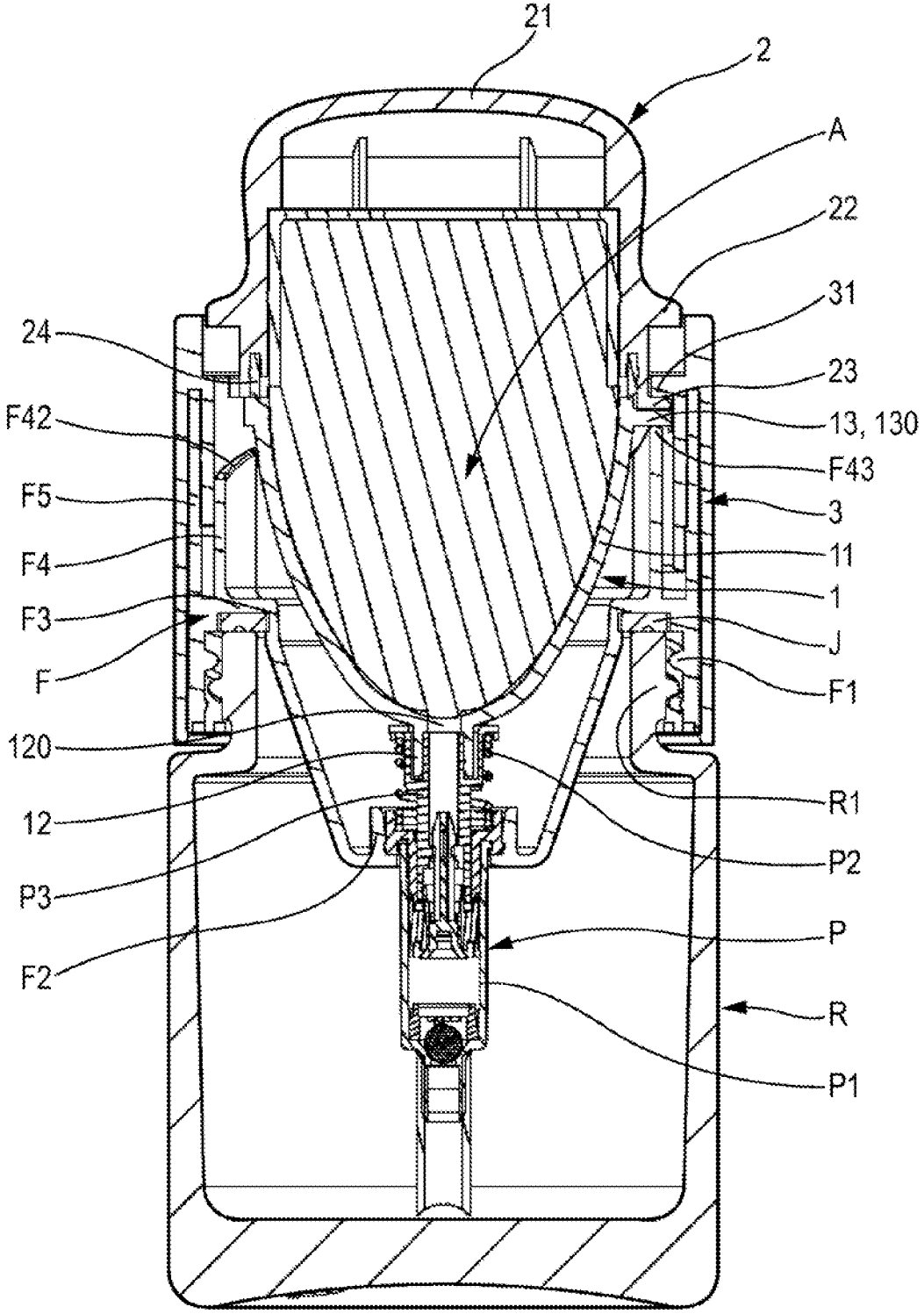
FIG. 1 is a vertical section view through a dispenser of the invention, in the locked state.

As can be seen in FIG. 1, the dispenser comprises the following constituent elements, namely a fluid product reservoir R, a pump P, a fastening ring F, a locking crown 3, a cup 1 and a removable member 2.

The reservoir R and the pump P are not critical elements for the present invention. The reservoir R can be made of any appropriate material, such as glass, plastic, metal. The reservoir R defines an opening in the shape of a neck R1.

The pump P is a conventional pump comprising a pump body P1, a return spring P2, and an actuating stem P3 that moves down and up in the pump body P1 against the return spring P2, between an extended rest position and a depressed actuated position.

For fastening on the neck R1, the fastening ring F receives the pump body P1 in stationary manner, and is then catched on or around the neck R1 in stationary and leaktight manner. More precisely, the fastening ring F includes an assembly section F1 that comes into engagement, e.g. threaded engagement, with the neck R1. It also includes a reception section F2 in which the pump body P1 is received, for example by sealed snap-fastening. It also forms an annular plate F3 which makes it possible to compress a neck gasket J on the upper edge of the neck R1.

Figure 2:
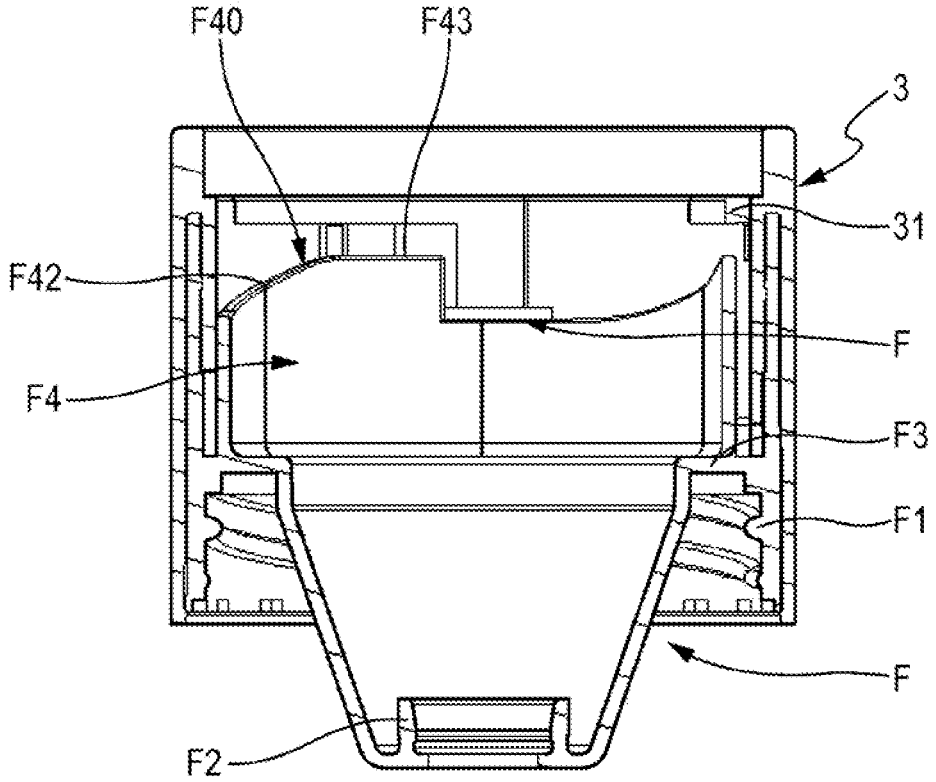
FIG. 2 is a partially sectional and plan view of the fixing ring and the trim band.

In the invention, the fastening ring F forms one or more locking ramps F40: in the example in the figures, there are three locking ramps F40. As can be seen in FIG. 2, the three ramps F40 are formed by the profiled (or crenellated) upper edge of a cylindrical bushing F4. Each ramp F40 defines a low ramp section F41 and a high ramp section F43 connected together by an inclined ramp section F42)

Figure 3:
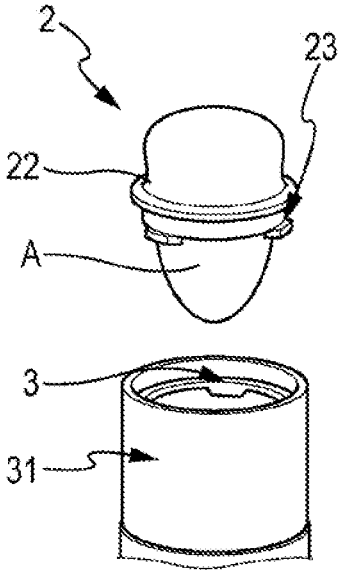
FIGS. 3 and 4 are partial perspective views of the dispenser in the open state.
Figure 4:
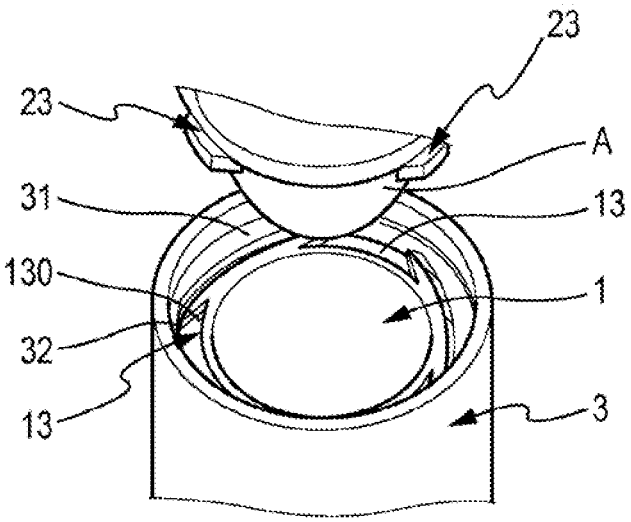

The fastening ring F also includes a support section F5 which here extends around the socket F4. The support section F5 receives the locking crown 3 that forms three fixed flanges 31 that are crescent shaped and that are arranged in a triangle. As can be seen in FIGS. 3 and 4, the flanges 31 project inwards and they are arranged at 120° relative to one another. Between two adjacent flanges, an access notch or slot 32 is formed, such that there are as many access slots 32 as there are flanges 31, and they are likewise arranged at 120° relative to one another. The flanges 31 may be spaced apart from one another by the access slots 32 or they may be touching, in such a manner that the access slots 32 are formed at the junctions of two adjacent flanges. The flanges 31 and the slots 32 co-operate with one another to form a shaped inner edge roughly in the shape of a triangle with sides that curve outwards and vertices that are truncated or blunt. The number of flanges and slots is not limiting.

In the invention, the cup 1 is mounted on the pump P so as to accommodate the fluid dispensed by the pump. The cup 1 includes a connection sleeve 12 that engages with the free end of the actuating stem P3 of the pump P. The sleeve 12 is mounted to rotate on the actuating stem or, as a variant, the sleeve 12 can drive the actuating stem in rotation. The sleeve 12 is extended by a feed orifice 120 that opens out into the bottom of a reception dish 11 that may present the shape of an upsidedown dome that is rounded, being substantially hemispherical in the figures, but that could equally well be ogival, oblong, or ovoid.

The upper edge of the bucket 1 comprises three tongues 13 that project outwards and that are arranged at 120° relative to one another. Each tongue 13 forms a reception housing 130. The tongues 13 are disposed beneath the fixed flanges 31 and cannot engage in the access slots 32, such that the tongues 13 can move in rotation beneath the fixed flanges 31, but remain captive. On the other hand, the tongues 13 extend outwards above the locking ramps F40, so that the bucket is blocked axially, when its tongues 13 are located axially above the high ramp sections F43, as can be seen in FIG. 1. In other words, the tongues 13 are wedged axially between the fixed flanges 31 and the ramps F40.

At this point, it should be understood that moving the cup 1 downwards towards the pump P causes the actuating stem P3 to be depressed, thereby causing fluid product to be dispensed through the stem P3, then through the feed orifice and into the dish 11.

In the invention, the removable member 2 is a distinct upper sub-assembly intended for co-operating with the other lower sub-assembly, constituted by the reservoir R, the pump P, the fastening ring F, the cup 1, and the locking crown 3. The removable member 2 includes a gripping element 21 for being gripped by the user so as to manipulate the removable member. The removable member 2 may include a gasket 24 that comes to be flattened against the edge the cup 1 in the closed position of the dispenser. The removable member 2 also includes an applicator A which in this embodiment is ogival. In a variant, the application surface may be conical, or even cylindrical. It may also form one or more plane faces. Advantageously, the applicator A is mounted in removable manner in the gripping element 21, so that the applicator A can be removed from the gripping element 21 so as to clean it or so as to replace it.

In the invention, the removable member 2 forms three projecting fins 23 that are arranged at 120° relative to one another. It can be seen in FIGS. 3 and 4 that these fins 23 also project downwards relative to the lower annular edge of the gripping element 21. The three fins 23 are initially intended to cooperate with the locking crown 3. More precisely, the three fins 23 need to be oriented angularly so as to be inserted between the flanges 31 and in the three access slots 32 of the crown 3. The fins 23 thus come to fit in the receiving housings 130 formed by the tongues 13 of the cup 1. This is done without the actuating stem P3 being depressed: it therefore remains in its extended rest position. The removable member 2 can then be driven in rotation so as to engage the fins 23 beneath the fixed flanges 31. It should be noted that the cup 1 is also driven in rotation, because of the connection in rotation obtained by the insertion of the fins 23 into the housings 130. At the end of this rotation, which may be of the order of 60°, the fins 23 and the tongues 13 are arranged or wedged between the fixed flanges 31 and the high ramp sections F43, as can be seen in FIG. 1. It can be said that the tongues 13, the fins 23, the flanges 31 and the ramps F40 all together form locking means. In addition, the fins 23 and the housings 130 together form rotational connection means, which prevent the applicator A from being damaged by twisting against the inside wall of the cup 1.

Furthermore, the applicator A is made of an elastically-deformable material that returns to its initial shape. This material presents a compression ratio of 5% to 50%. Compression occurs axially and/or radially. If we consider that the applicator A presents an axial rest height when the applicator A is not constrained in the cup 1, and a smaller axial height when it is constrained in the cup 1 by the locking means 26, 31, the smaller axial height representing less than 90%, advantageously between than 95% and 75% of the axial rest height. As a result, an applicator A is available with an application surface area that is large, even though the dish 11 of the cup is significantly smaller. The material used for the applicator A may be a foam having open or closed cells.

A complete operating cycle of the dispenser of the invention is described below, starting from FIG. 1.

In FIG. 1, the dispenser is in the locked position: the fins 23 and the tongues 13, integral in rotation, are sandwiched between the fixed flanges 31 and the high ramp sections F43. Consequently, the removable member 2 and the cup 1 are blocked axially. The pump P is in its rest position, with its actuating stem P3 completely extended.

Figure 5:
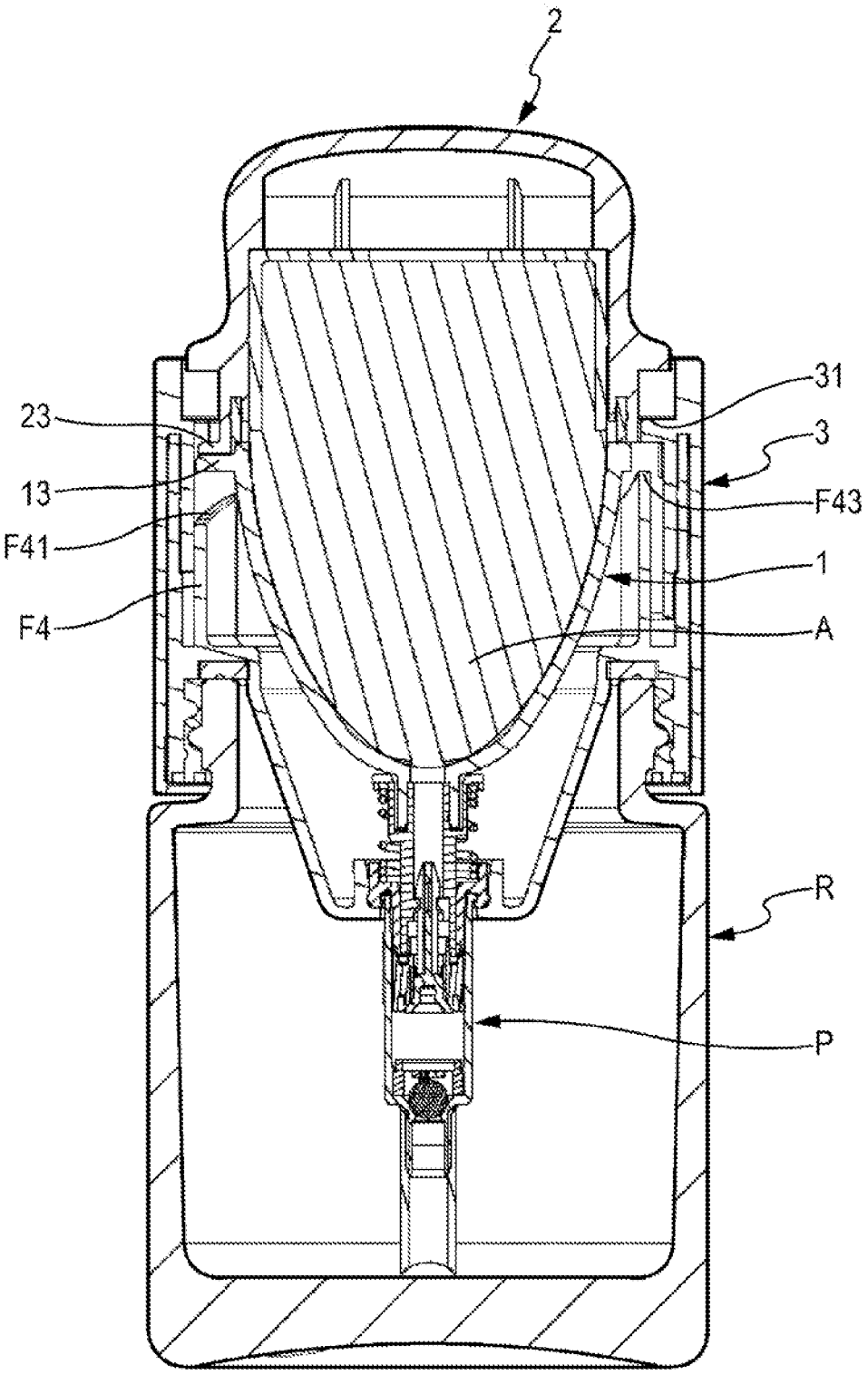
FIG. 5 is a view similar to the view in FIG. 1 in the unlocked state.
Figure 6:
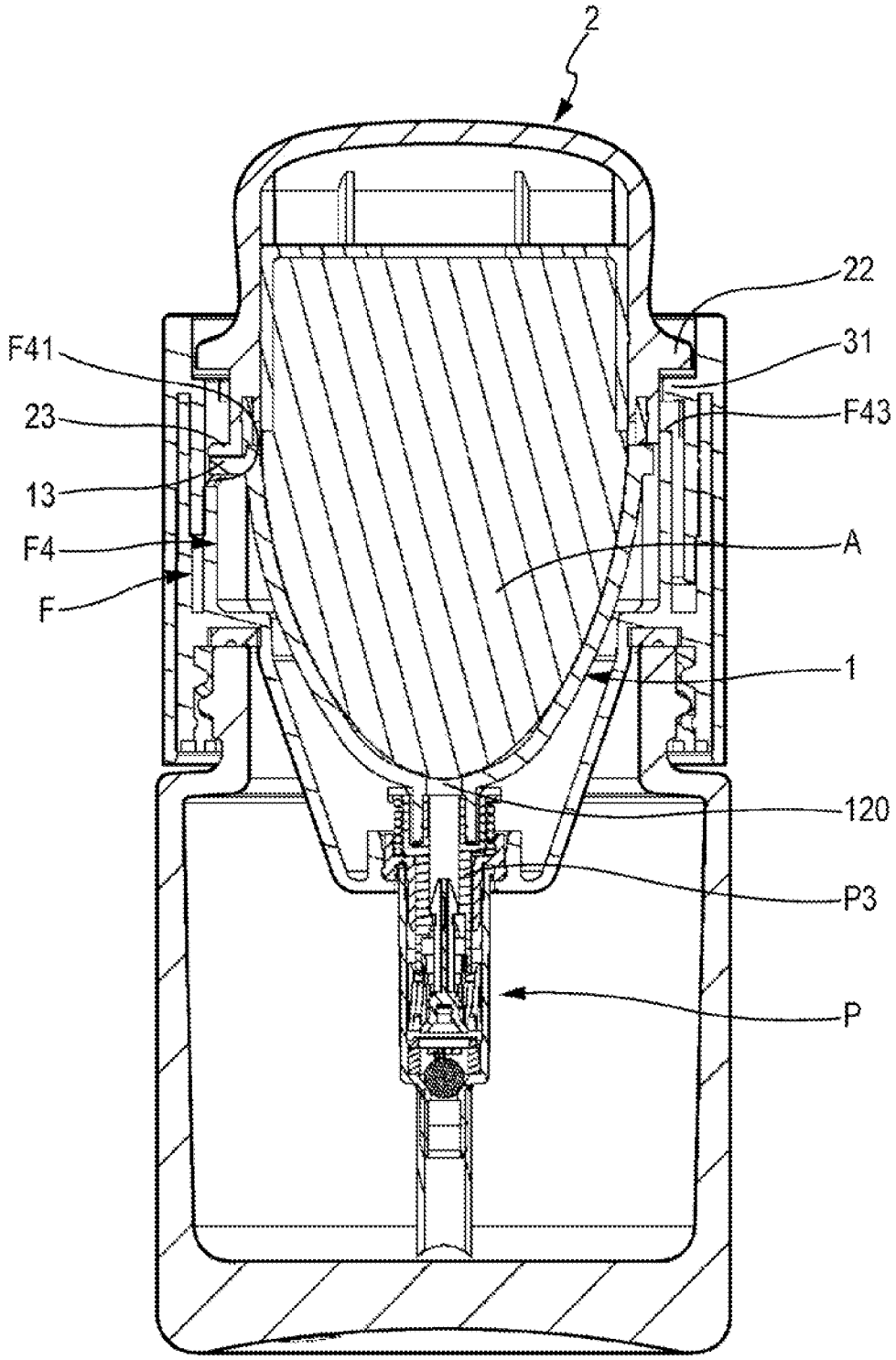
FIG. 6 is a view similar to FIGS. 1 and 5, in the actuated state.

From this locked position, the user can grip the gripping element 21 so as to impart a counterclockwise rotational movement thereto. In this way, the fins 23 disengage from beneath the flanges 31 and the tongues 13 disengage from the high ramp sections F43. The rotation continues until the fins 23 are positioned between the flanges 31 and the tongues axially above the low ramp sections F41. The dispenser is then unlocked and can be actuated. This is shown in FIG. 5. It should be noted that the actuating stem P3 remained static during this unlocking phase.

From this unlocked position, the user can press axially on the gripping element 21, thereby causing the cup 1 to move towards the pump P and causing the actuating stem P3 to be depressed. In response, a dose of fluid is forced by the pump P into the cup 1, where it is immediately withdrawn by the applicator A.

The user can then release his pressure on the removable member 2, which is returned into its rest position by the return spring P2 of the pump P. The dispenser is again in the unlocked position of FIG. 5. It can therefore remove the removable member 2 from the cup 1 in order to bring the applicator into contact with the desired application surface (skin, nails, hair, etc.).

Once the application has been completed, the user puts the removable member 2 back in place, taking care to orient it correctly, so that its fins 23 can pass between the fixed flanges 31 and be housed in the housings 130. Then, a simple clockwise rotation makes it possible to bring the fins 23 and the tongues 13 back between the flanges 31 and the high ramp sections F43. In this respect, it should be noted that the inclined ramp sections F42 will progressively bring the tongues 13 back onto the high ramp sections F43, in the event that the actuating stem P3 has not returned of its own accord to the extended rest position.

The invention thus provides a fluid product dispenser/applicator having locking means that make it possible to obtain the following advantages:

- the applicator A does not rub against the cup, given that they are integral in rotation, the fluid is isolated in the pump, given that the actuating stem is returned to the extended position by the locking ramps, very little air in the cup, given that the applicator fills it completely, easy cleaning or replacement of the applicator.

The invention claimed is:

1. A fluid product dispenser, comprising:

a fluid product reservoir;

a pump having a pump body, and an actuating stem that is axially movable down and up between an extended rest position and a depressed actuated position;

a cup for accommodate the fluid output by the pump, the cup being mounted on the actuating stem;

a removable member suitable for engaging with the cup and comprises an applicator held in the cup so as to take up the fluid, the applicator being elastically deformable and constrained in the cup by means of rotational locking means comprising a plurality of fixed flanges, and a plurality of fins integral with the removable member, the fins being suitable for engaging beneath the fixed flanges by rotating the removable member, wherein the cup and the removable member are provided with rotational connection means, such that the removable member drives the cup in rotation on the actuating stem, as soon as the removable member is engaged with the cup.

2. The fluid product dispenser according to claim 1, wherein the rotational connection means comprise a plurality of receiving housings formed by the cup and a plurality of connection profiles formed by the removable member, the connection profiles being housed in the receiving housings, as soon as the removable member is that is engaged with the cup.

3. The fluid product dispenser according to claim 2, wherein the connection profiles are formed by the fins.

4. The fluid product dispenser according to claim 1, wherein the rotational locking means further comprises at least one locking ramp defining a low ramp section and a high ramp section connected together by an inclined ramp section, the low ramp section being positioned between two of the plurality of fixed flanges and the high ramp section being positioned axially beneath a-one of the plurality of fixed flanges, so that the cup and the removable member are locked axially with a fin and a receiving housing disposed between the high ramp section and one of the plurality of fixed flanges, with the actuating stem in the extended position of rest.

5. The fluid product dispenser according to claim 1, wherein the removable member includes an abutment collar that comes into axial abutment on the plurality of fixed flanges when the actuating stem is in the depressed position.

6. The fluid product dispenser according to claim 4, comprising three fixed flanges, three fins, three receiving housings and three locking ramps, so that the rotation of the removable member is limited to 60°.

7. The fluid product dispenser according to claim 1, wherein the applicator presents a axial rest height when it is not constrained in the cup, and a smaller axial height when it is constrained in the cup by the rotational locking means, the smaller axial height representing advantageously between 75% to 95% of the rest axial height.

8. The fluid product dispenser according to claim 1, wherein the applicator presents a compression ratio, both axially and radially, of at least 15%.

9. The fluid product dispenser according to claim 1, wherein the applicator fills the cup completely, when it is constrained therein by the rotational locking means.

10. The fluid product dispenser according to claim 4, comprising a fastening ring supporting the pump and mounted on the reservoir, the fastening ring forming the at least one locking ramp.

11. A fluid product dispenser according to claim 10, wherein a locking crown is mounted on the fastening ring, this locking crown forming the fixed flanges.

* * * * *